US010056025B2

(12) United States Patent
Jo et al.

(10) Patent No.: US 10,056,025 B2
(45) Date of Patent: Aug. 21, 2018

(54) VARIABLE VCOM LEVEL GENERATOR

(71) Applicant: IML International, Grand Cayman (KY)

(72) Inventors: Yoo Dong Jo, Asan-si (KR); Omeshwar Suryakant Lawange, Milpitas, CA (US)

(73) Assignee: IML International, Grand Cayman (KY)

( * ) Notice: Subject to any disclaimer, the term of this patent is extended or adjusted under 35 U.S.C. 154(b) by 92 days.

(21) Appl. No.: 15/299,317

(22) Filed: Oct. 20, 2016

(65) Prior Publication Data

US 2017/0249892 A1 Aug. 31, 2017

Related U.S. Application Data

(60) Provisional application No. 62/343,707, filed on May 31, 2016, provisional application No. 62/244,057, filed on Oct. 20, 2015.

(51) Int. Cl.

| | |
|---|---|
| ***G09G 3/20*** | (2006.01) |
| ***G09G 3/36*** | (2006.01) |
| ***G09G 5/00*** | (2006.01) |

(52) U.S. Cl.

CPC ..... *G09G 3/2092* (2013.01); *G09G 3/3655* (2013.01); *G09G 5/008* (2013.01); *G09G 3/3648* (2013.01); *G09G 3/3696* (2013.01); *G09G 2320/0247* (2013.01); *G09G 2330/028* (2013.01); *G09G 2340/0435* (2013.01)

(58) Field of Classification Search

CPC ..... G09G 3/3655; G09G 3/3696; G09G 2340/0435; G09G 3/3688; G09G 2310/0291; G09G 3/3614; G09G 2320/0247; G09G 2310/0292

USPC ..... 345/96, 212, 214

See application file for complete search history.

(56) References Cited

U.S. PATENT DOCUMENTS 8,159,439 B2 * 4/2012 Lee ..... G09G 3/3688 345/208

2009/0058763 A1 * 3/2009 Doi ..... G09G 3/3688 345/55

* cited by examiner

*Primary Examiner* — Koosha Sharifi-Tafreshi

(74) *Attorney, Agent, or Firm* — Aka Chan LLP

(57) ABSTRACT

A variable Vcom level generator circuit generates a variable Vcom voltage level. A variable Vcom voltage can be used for variable refresh rate display technology to prevent flicker on a display panel. The Vcom level can be changed based on the vertical frequency being used or can be changed based on external control signals.

20 Claims, 12 Drawing Sheets

VARIABLE VCOM LEVEL GENERATOR

CROSS-REFERENCE TO RELATED APPLICATIONS

This application claims the benefit of U.S. patent applications 62/343,707, filed May 31, 2016, and 62/244,057, filed Oct. 20, 2015, which are incorporated by reference along with all other references cited in this application.

BACKGROUND OF THE INVENTION

The invention is related to the field of electrical circuits and more specifically to driver circuitry for display panel products.

Electronic visual displays are used in a wide range of applications including computer monitors, televisions, instrument panels, aircraft cockpit displays, and signage. They are common in consumer devices such as laptop computers, video players, music players, gaming devices, clocks, watches, calculators, telephones, smartphones, tablets, and many other devices.

Some examples of display panel technologies include liquid crystal displays (LCDs), organic led emitting diode (OLED) displays, and plasma displays. Such displays operate according to various principles. For example, LCDs use the light modulating properties of liquid crystals to produce images. Since LCDs do not emit light, there is often a backlight behind the LCD panel to illuminate the display. Other display technologies work according to different principles.

Electronics are used to drive an electronic display. These electronics provide power and electrical input. For example, there are voltages for the row and column drivers to drive a thin-film transistor (TFT) LCD. Electronics generate voltage waveforms to achieve (1) color output stability to alleviate flickering and inconsistent color, and (2) liquid crystal stability to prevent display damage due to localized net voltage build-up.

Further, a LCD display panel has a VCOM input. VCOM is adjusted to match the capacitance and performance specifications of the TFT panel to maximize contrast and minimize flickering. The VCOM can be a programmable function, which can be used to adjust a panel to maximize contrast, minimize flickering during operation, and optimize panel performance.

It is desirable to improve electronics used to drive electronic visual displays, so that these displays and the electronics used to drive them to improve performance, reduce cost, and reduce power consumption. Therefore, improved electronics and circuits are needed.

BRIEF SUMMARY OF THE INVENTION

A variable Vcom level generator circuit generates a variable Vcom voltage level. A variable Vcom voltage can be used for variable refresh rate display technology to prevent flicker on a display panel. The Vcom level can be changed based on the vertical frequency being used or can be changed based on external control signals.

In an implementation, a method includes adjusting a Vcom level of a display by changing a frame rate for an adaptive sync display. Specifically, aspects of changing the Vcom level can include:

1. Using control bits to select a location in a register file. The register file outputs the value at the selected location to a digital-to-analog converter. The value that is input to the digital-to-analog converter cause the Vcom circuit to generate a particular Vcom voltage level.

2. The Vcom levels are programmable or user selectable. The circuit has a digital interface. Through the digital interface, the user can input, store, or adjust values in the register file. These values stored in the register select the particular Vcom voltage levels.

3. The circuit can include a frequency detection circuit. A video signal is input to the frequency detection circuit, which determines a vertical frequency. The frequency is input to a frequency value setting circuit. Based on the frequency, the frequency value setting circuit generates control signals for the register, to select an appropriate register location for a particular Vcom level.

4. The Vcom level for a frequency or frequency range is programmable or user selectable. Through the digital interface, the user can input, store, or adjust values in or associated with the frequency value setting circuit (or register file). These values will select the particular Vcom voltage level for a frequency or a frequency range.

In an implementation, a method includes: receiving a vertical frequency signal; providing a reference clock at a predetermined, known, or reference frequency; detecting a first pulse in the vertical frequency signal; detecting a second pulse in the vertical frequency signal, where the second pulse is after the first pulse; upon detecting the first pulse, counting using a counter circuit, clocked by the reference clock, a number of reference clock cycles between the first pulse and the second pulse to obtain a first count value; based on the first count value, selecting a first register in the register block to output to a digital-to-analog converter (DAC) circuit, where the first register stores a first binary value; based on the first binary value, generating a first DAC voltage output; and based on the first DAC voltage output, generating a first VCOM voltage output level on a VCOM voltage output line.

The method can further includes: detecting a third pulse in the vertical frequency signal, where the third pulse is after the second pulse; after obtaining a first count value, resetting the counter circuit to zero; upon detecting the second pulse, counting using the counter circuit a number of reference clock cycles between the second pulse and the third pulse to obtain a second count value, where the second count value is greater than the first count value;

based on the second count value, selecting a second register in the register block to output to the DAC circuit, where the second register stores a second binary value, and the second binary value is different from the first binary value; based on the second binary value, generating a second DAC voltage output, where the second DAC voltage output is different from the first DAC voltage output; based on the second DAC voltage output, at the VCOM voltage output line, changing from the first VCOM voltage output level to a second VCOM voltage output level, where the second VCOM voltage output level is different from the first VCOM voltage output level.

In various implementations, when the first count value is greater than the second count value, the second VCOM voltage output level is greater than the first VCOM voltage output level. When the first count value is greater than the second count value, the second VCOM voltage output level is less than the first VCOM voltage output level. When the first count value is less than the second count value, the second VCOM voltage output level is greater than the first VCOM voltage output level. When the first count value is less than the second count value, the second VCOM voltage output level is less than the first VCOM voltage output level.

The vertical frequency signal can be received from a T-con circuit of a display panel. The method can include: via digital interface control signals, programming via a digital interface circuit the first binary value that is stored in the first register of the register block.

The based on the first DAC voltage output, generating a first VCOM voltage output level on a VCOM voltage output line can include: connecting an output of the digital-to-analog converter (DAC) circuit through at least one operational amplifier circuit to the VCOM voltage output line. The based on the first DAC voltage output, generating a first VCOM voltage output level on a VCOM voltage output line can include: connecting an output of the digital-to-analog converter (DAC) circuit through at least two operational amplifier circuits to the VCOM voltage output line.

The method can include: providing a first impedance value connected between a first supply line and a first node; providing a second impedance value connected to a second supply line and the first node; and connecting the first node to an input of an operational amplifier circuit. An output of the operational amplifier circuit is connected to the VCOM voltage output line. There can be a first operational amplifier circuit and a second operational amplifier circuit. Then, the method can include connecting a transistor between the first operational amplifier circuit the second operational amplifier circuit. The counter circuit and DAC circuit can reside on or be formed on a single integrated circuit (e.g., same integrated circuit body or substrate).

In an implementation, a device includes: a frequency detector circuit, connected to a vertical frequency signal line of a display, where the frequency detector circuit includes a counter circuit; a register block, connected to frequency detector circuit, where the register block receives a value based on the counter circuit; a digital-to-analog converter circuit, connected to the register block; a first operational amplifier, comprising a first input connected to the digital-to-analog converter circuit; a transistor connected to an output and a second input of the first operational amplifier; and a second operational amplifier, comprising a first input connected to the transistor and a output connected to a VCOM voltage output.

In various implementations, the device includes a digital interface control circuit, connected to the register block. The device includes: a first impedance connected between a supply line and a first node; and a second impedance connected between the first node and a ground line. The first node is connected to the first input of the second operational amplifier. The device includes a supply line, connected to the second operational amplifier; and a first impedance connected between the supply line and the digital-to-analog converter circuit.

The digital-to-analog converter circuit can be a 7-bit digital-to-analog converter circuit and the register block is 7 bits wide. The register block can include 8 registers, and the VCOM voltage output can provide up to 8 different VCOM voltage levels. The frequency detector circuit, counter circuit, digital-to-analog converter circuit, and register block can reside on a single integrated circuit.

In an implementation, a method includes: receiving a vertical frequency signal from a display panel; providing a reference clock at a reference frequency; detecting a first pulse in the vertical frequency signal; detecting a second pulse in the vertical frequency signal, where the second pulse is after the first pulse; upon detecting the first pulse, counting using a counter circuit, clocked by the reference clock, a number of reference clock cycles between the first pulse and the second pulse to obtain a first count value; based on the first count value, selecting a first register in the register block to output to a digital-to-analog converter (DAC) circuit, where the first register stores a first binary value; based on the first binary value, generating a first DAC voltage output; based on the first DAC voltage output, generating a first VCOM voltage output level on a VCOM voltage output line; and detecting a third pulse in the vertical frequency signal, where the third pulse is after the second pulse.

The method includes: after obtaining a first count value, resetting the counter circuit; upon detecting the second pulse, counting using the counter circuit a number of reference clock cycles between the second pulse and the third pulse to obtain a second count value, where the second count value is greater than the first count value; based on the second count value, selecting a second register in the register block to output to the DAC circuit, where the second register stores a second binary value, and the second binary value is different from the first binary value; based on the second binary value, generating a second DAC voltage output, where the second DAC voltage output is different from the first DAC voltage output; and based on the second DAC voltage output, at the VCOM voltage output line, changing from the first VCOM voltage output level to a second VCOM voltage output level, where the second VCOM voltage output level is different from the first VCOM voltage output level.

The method can further include: connecting an output of the DAC circuit to a first operational amplifier circuit; connecting an output of the first operational amplifier circuit to a transistor; and connecting the transistor to an input of a second operational amplifier circuit, where an output of the second operational amplifier circuit includes the VCOM voltage output line.

Other objects, features, and advantages of the present invention will become apparent upon consideration of the following detailed description and the accompanying drawings, in which like reference designations represent like features throughout the figures.

DETAILED DESCRIPTION OF THE INVENTION

Figure 1:
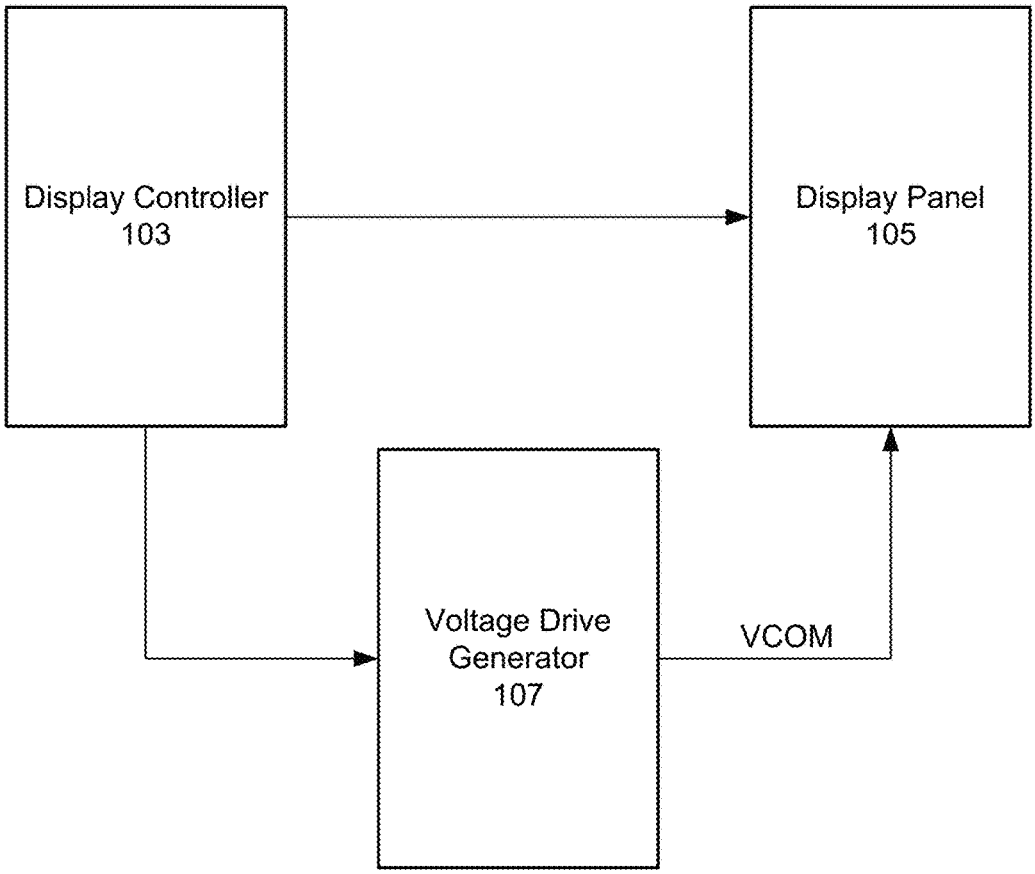
FIG. 1 shows a block diagram of a display system.

FIG. 1 shows a block diagram of a display system. This display system can be incorporated in computer monitors, televisions, instrument panels, aircraft cockpit displays, signage, laptop computers, video players, music players (e.g., Apple's iPod product family), gaming devices, cameras, clocks, watches, calculators, telephones, smartphones (e.g., Apple's iPhone product family, Google's Nexus product family, Samsung's Galaxy product family), tablets (e.g., Apple's iPad product family, Google's Nexus product family, or Samsung's Galaxy product family), and many other devices.

The display system includes a display controller 103 that drives a display panel 105 and a voltage drive generator 107, which also drives the display panel. The voltage drive generator can generate a reference voltage for the display panel.

Figure 2:
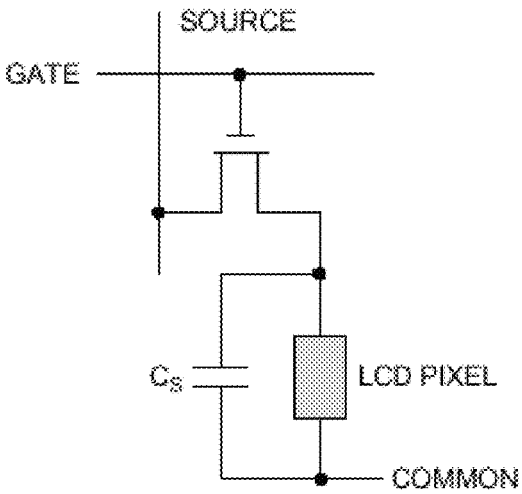
FIG. 2 shows a circuit diagram for a single LCD pixel.

The display system can be an LCD display system, such as for an active matrix thin-film transistor (TFT) display. FIG. 2 shows a circuit diagram for a single LCD pixel. Numerous pixels are arranged in an array to form a display panel. In an implementation, the voltage drive generator generates the VCOM reference voltage for pixels of the display panel.

Some common resolutions for panels includes 7680 by 4320 (e.g., 8K), 4096 by 2304 (e.g., 4K), 3840 by 2160 (e.g., 4K UHD), 2800 by 1800, 2560 by 1200, 2560 by 1400, 1600 by 1200, 1920 by 1080 (e.g., HD 1080), 1280 by 720 (e.g., 720p), 1136 by 640 (e.g., iPhone 5), 1280 by 768, 960 by 640 (e.g., iPhone 4S), 1024 by 768, 800 by 600, 800 by 480, 640 by 480, 480 by 320, and many more.

The TFT LCD is panel includes glass, a TFT array substrate, liquid crystal, a polarizer, color filters, and other components to implement a TFT LCD. The drive electronics of a TFT activate the TFT array substrate, resulting in an induced electromagnetic field that affects the liquid crystal. The liquid crystal is twisted in response to the induced electromagnetic field, allowing light to shine through the liquid crystal and the glass sandwich. The light intensity of the transmitted light is modulated by the color filters to output the desired color.

In other implementations, the display panel can be of another LCD technology, such as a passive-matrix LCD, super-twisted nematic (STN), double-layer STN (DSTN), or color-STN (CSTN). Or the display panel can use organic light emitted diode (OLED). Aspects of the invention can be applied to various display panel technologies.

A VCOM circuit outputs a VCOM reference voltage, which is typically used with or in an LCD screen. LCD screens have an array of pixels constantly lit by a backlight. The constancy of the light removes the type of flicker usually associated with cathode ray tube (CRT) screens (phosphors pulsing with each refresh cycle). Instead, an LCD pixel has upper and lower plates with grooves cut perpendicular to each other as in. These grooves align the liquid crystals to form channels for the backlight to pass through to the front of the panel. The amount of light emitted depends upon the orientation of the liquid crystals and is proportional to the applied voltage.

Referring to FIG. 2, the gate voltage acts as a switch signal and is commonly amplified to become −5 volts to 20 volts. The video source, typically ranging from 0 volts and 10 volts, provides the intensity information that appears across the pixel. The bottom of the pixel is commonly connected to the backplane of the panel. The voltage at this node is VCOM (the VCOM reference voltage).

While this set-up is functional, it reduces panel lifetime. Assuming the VCOM voltage is at ground, the voltage across the pixel varies from 0 volts to 10 volts. Assuming an average of 5 volts, there is substantial DC voltage across each pixel. This DC voltage causes charge storage, or memory. In the long term, it is a form of aging, degrading the pixels by electroplating ion impurities onto one of the electrodes of the pixel. This contributes to image retention, commonly known as a sticking image.

The construction of the LCD panel is generally symmetrical and either a positive or a negative voltage can be used to align the crystals. A technique is to adjust the common voltage (VCOM) to a midpoint of the video signal (e.g., 10/2, which is 5 volts) or other desired voltage level (e.g., 2/3, 3/4, or other percentage of the maximum signal voltage). Now the video signal swings above and below the common voltage (VCOM), creating a net zero effect on the pixel. This net zero effect on the liquid crystal eliminates the aging and image retention issues. A tradeoff for this technique is resolution, since the video signal travels 5 volts to full brightness instead of the entire 10-volt range.

The VCOM voltage should be set very precisely (e.g., around midpoint or 1/2 of the AVDD power rail, 2/3 of signal voltage, or other value) to avoid flicker. To illustrate why a panel will flicker, let's assume that due to manufacturing of the panel the VCOM is 5.5 volts. If the video signal swings between 0 volts and 10 volts, the full-scale voltage will be different on each field. On one field, the full-scale voltage will be 4.5 volts and on the other, the full-scale voltage will be 5.5 volts. This difference in full-scale voltage translates to a difference in intensity, experienced as flicker.

Due to the variations in construction of each panel, the optimal VCOM voltage can differ from panel to panel or across a single panel. It is important to be able to set the VCOM precisely and also be able to change it as needed to work optimally with a particular panel.

In the specific implementation shown, the display controller and voltage drive generator are circuits residing on separate integrated circuits or different semiconductor substrates. But in other implementation, some or all components of the voltage drive generator can be incorporated into the drive controller integrated circuit (or alternatively, integrated within the display panel).

Previously, displays and their display driver circuits had a fixed refresh rate such as 60 Hertz. Newer displays and their display driver circuits can support variable refresh rates. In such a monitor, the refresh rate can be changed, for example, from about 10 Hertz to about 144 Hertz. Some examples of variable refresh rate technology include G-Sync from Nvidia and FreeSync from AMD, which is also know as Adaptive Sync from VESA. These technologies allow varying of the refresh rate of the graphic processor in order to provide improved visual quality and lower power consumption.

An improved VCOM generator circuit is needed to address variable refresh rate technology. U.S. patent applications 62/242,230, filed Oct. 15, 2015, 62/244,057, filed Oct. 20, 2015, U.S. Ser. No. 15/294,295, filed Oct. 14, 2016, and U.S. Ser. No. 15/295,814, filed Oct. 17, 2016, are incorporated by reference.

The display controller or graphic processor (GPU) generates a vertical frequency (fV) using a value set by user or customer manually. The display panel uses the vertical frequency received from the controller. For typical controllers, the amount the vertical frequency ranges can be adjusted is not wide, typically from about 50 Hertz to about 85 Hertz.

However, variable refresh rate technologies, such as G-Sync from nVidia, FreeSync from AMD, and Adaptive Sync from VESA, support a wider range of vertical frequency, from about 10 Hertz to about 144 Hertz, and vertical frequencies are varied during display panel is on operation.

Figure 3:
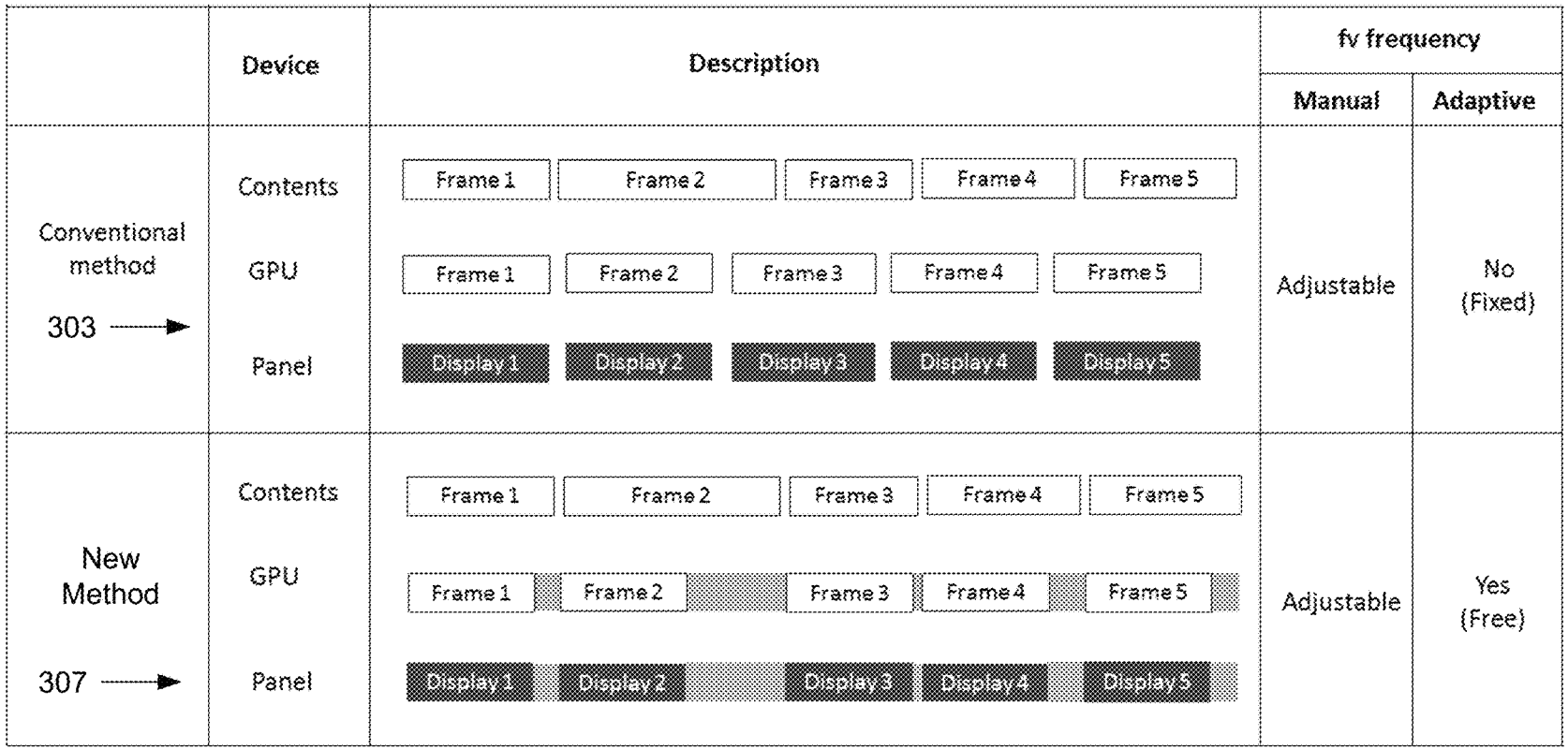
FIG. 3 shows a table of the operation comparing conventional vertical frequency operation and variable refresh rate operation.

FIG. 3 shows a table of the operation comparing conventional vertical frequency operation in row 303 and variable refresh rate operation in row 307. Referring to row 303, in conventional vertical frequency operation, the vertical frequency can be set manually, and does not change or adapt during operation of the display. In other words, after a vertical frequency is selected, that vertical frequency will be used with the display and the vertical frequency will not vary.

Referring to row 307, for variable refresh rate operation, the vertical frequency can be set manually, and can change and adapt during operation of the display. In other words, a vertical frequency can be selected, but during operation with a display, other vertical frequencies can be used, and the vertical frequency can change during operation.

Figure 4:
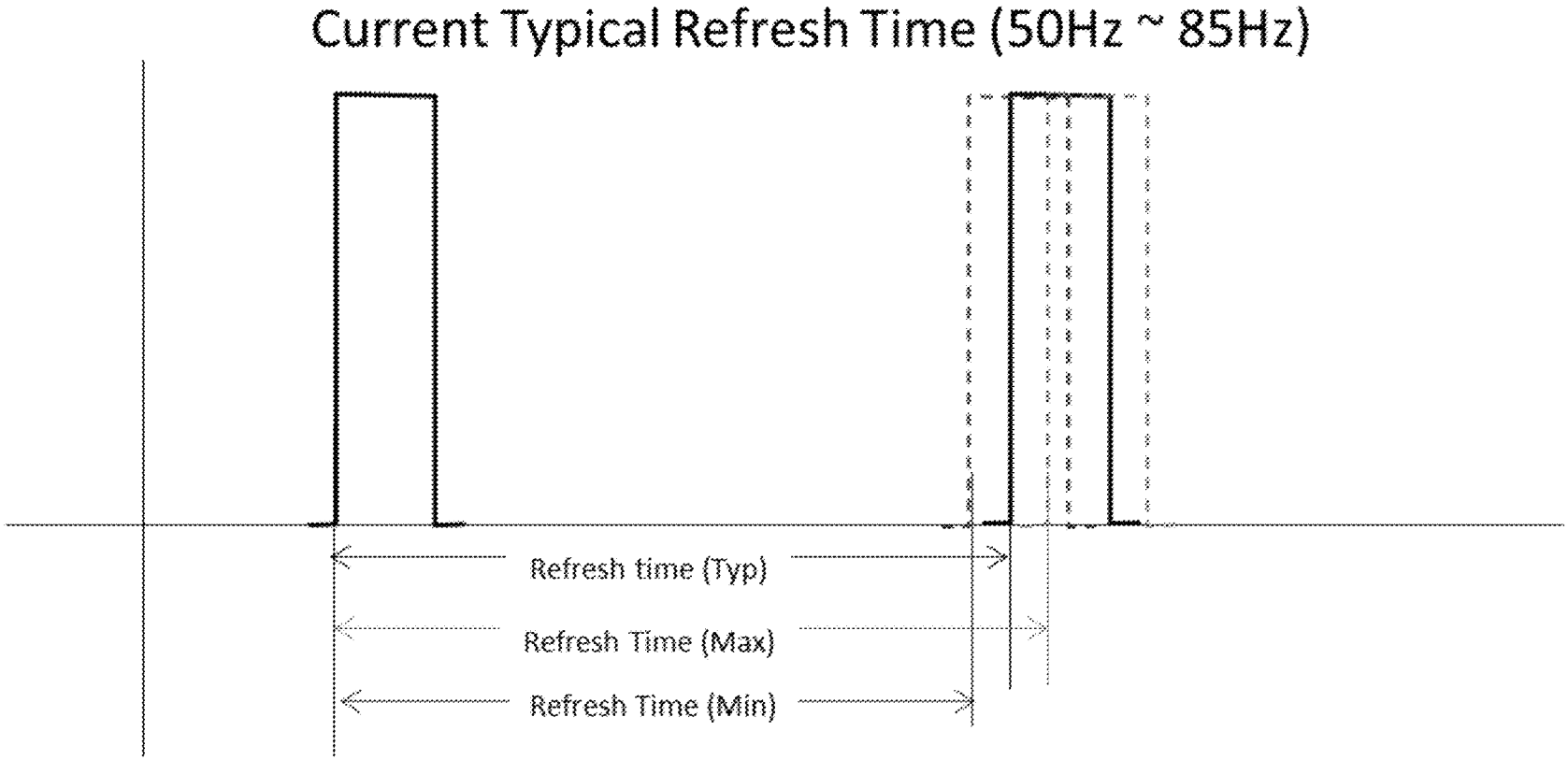
FIG. 4 shows a timing diagram for a typical refresh time of about 50 Hertz to about 85 Hertz.

FIG. 4 shows a timing diagram for a typical refresh time of about 50 Hertz to about 85 Hertz. In case of conventional method, it would be acceptable to manage flicker level with one fixed Vcom level because that ranges of vertical frequencies generated by GPU is not so wide to cause a flickering problem. Typically it is sufficient to adjust and fix the Vcom level for the panel at the factory before the panel is shipped. There would not be a big difference between average voltage level between odd and even when having one fixed Vcom level that can be adjusted.

Figure 5:
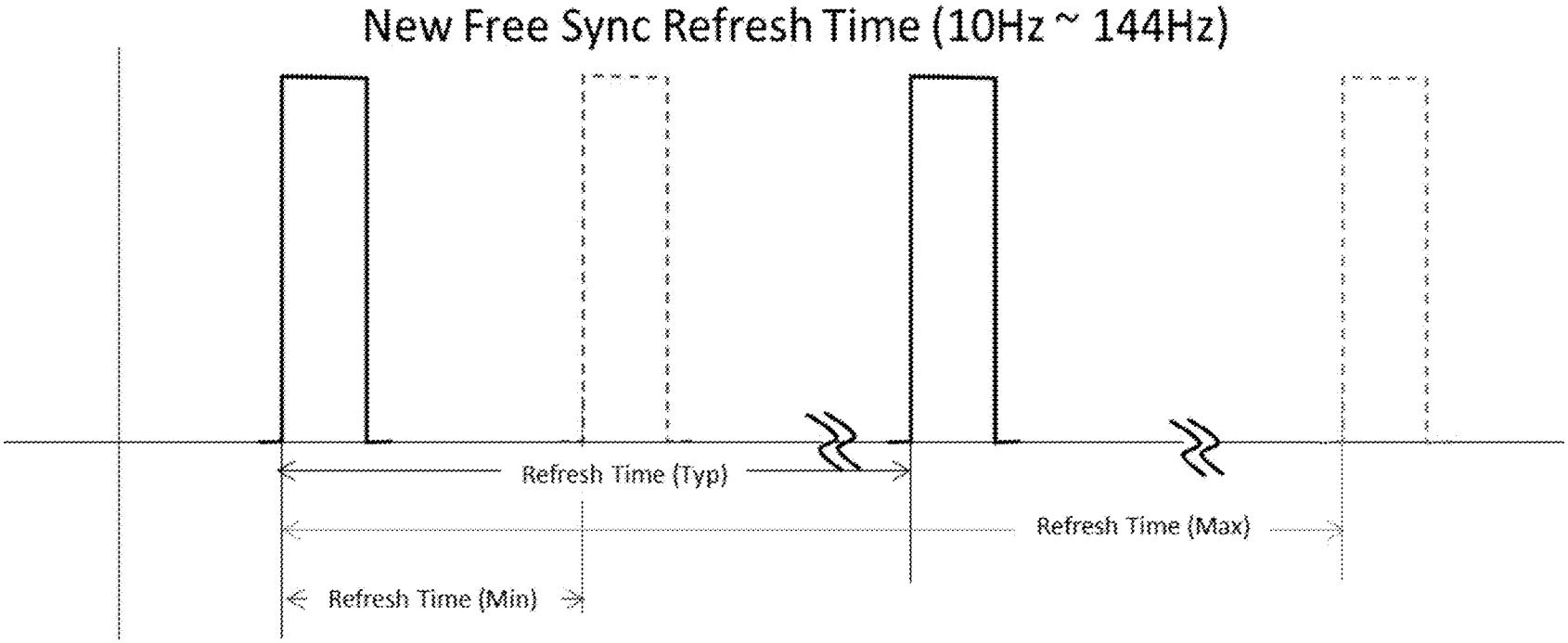
FIG. 5 shows a timing diagram for a variable refresh rate operation, with a wide refresh time from about 10 Hertz to about 144 Hertz.

FIG. 5 shows a timing diagram for a variable refresh rate operation, with a wide refresh time from about 10 Hertz to about 144 Hertz. The timing range for refresh is significantly greater than the conventional range, shown in FIG. 4.

Consequently, in case of variable refresh (e.g., FreeSync), it is difficult to optimize flicker level with one fixed Vcom level because that variable range of vertical frequency is much wider than conventional method. The variation in discharging time will be so great that flicker may result when using a fixed Vcom level.

Figure 6B:
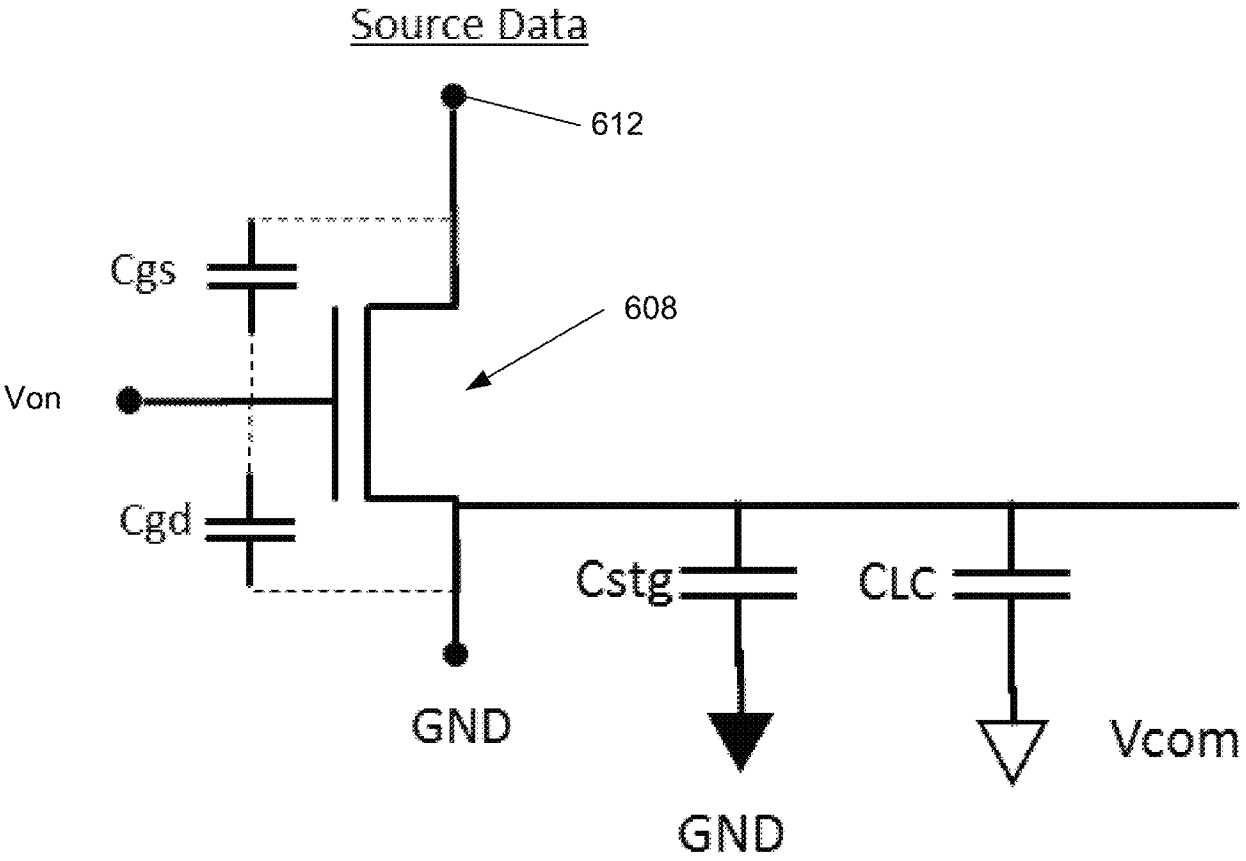
FIG. 6B shows an LCD pixel circuit including capacitances.
Figure 6A:
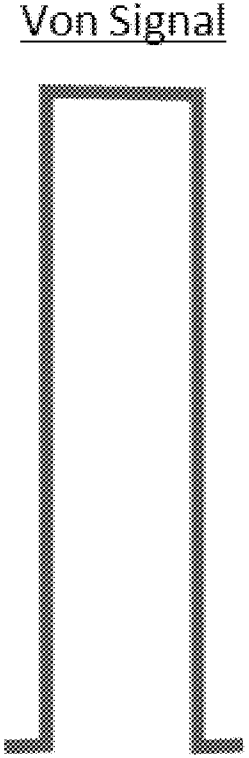
FIG. 6A shows a Von signal waveform.

FIG. 6A shows a Von signal waveform. FIG. 6B shows an LCD pixel circuit including capacitances. The Von voltage is a gate voltage for a transistor 608. A voltage of source data 612 is charges a capacitor Cstg through transistor 608 when Von signal is active on a gate of the transistor.

A liquid crystal element is voltage controlled device. So residual voltage in an electrode affects liquid crystal performance. A phase of source data voltage for a liquid crystal element in a panel should be inverted periodically in order to prevent trapping of ions in isolated layers because trapped ions operate like a residual voltage.

The circuit has not only Cstg and CLC capacitors or capacitances, but also Cgs and Cgd parasitic capacitances. These parasitic capacitances can cause asymmetric voltages between an even period and odd period operation.

Voltage (even) from source data 612 charges Cstg while Von is active. The charge stored by Cstg may drop a little when Von goes inactive. Further, the charge stored by Cstg slowly discharges toward to ground (not Vcom) until Von goes active again. Voltage (odd) from source data charges Cstg again. The charge stored by Cstg voltage may drop a little when Von goes inactive. Further, the charge stored by Cstg slowly discharges toward to ground until Von goes active again.

A voltage phase of the liquid crystal is decided based on Vcom (not ground). The charged voltage at Cstg is based on GND and operation of the liquid crystal is based on Vcom so applied voltage shape (area) at the liquid crystal between odd and even are different.

Figure 7:
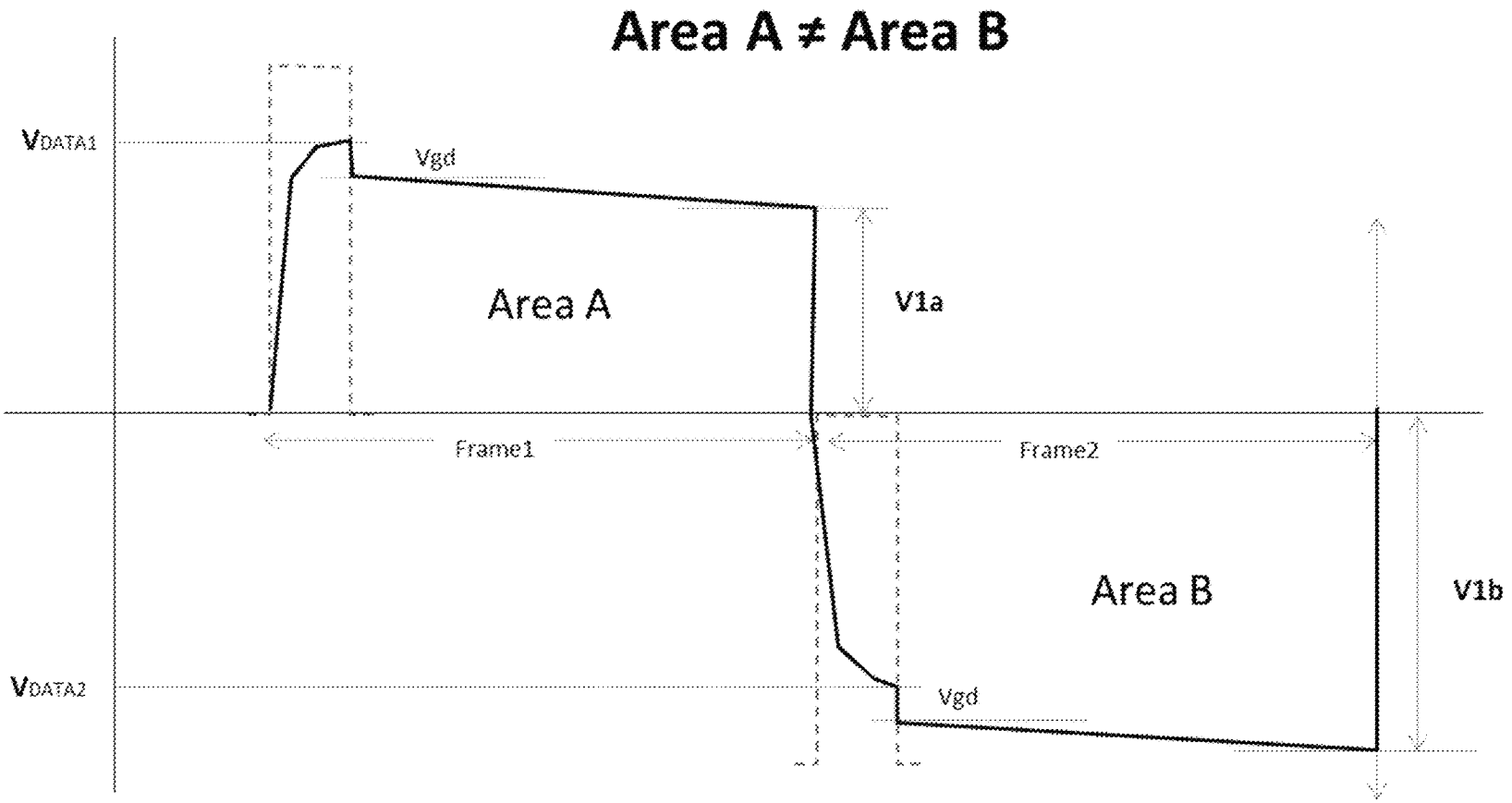
FIG. 7 shows a graph of voltage and discharge time for a single, fixed Vcom level.

FIG. 7 shows a graph of voltage and discharge time for a single, fixed Vcom level. In this example, ratio of area A' and area B': will be larger with fixed Vcom level because discharging time is longer. This means a gap of area A' and area B' will be larger and will make a larger flicker level. It is difficult to avoid flicker when using a fixed Vcom level.

Figure 8:
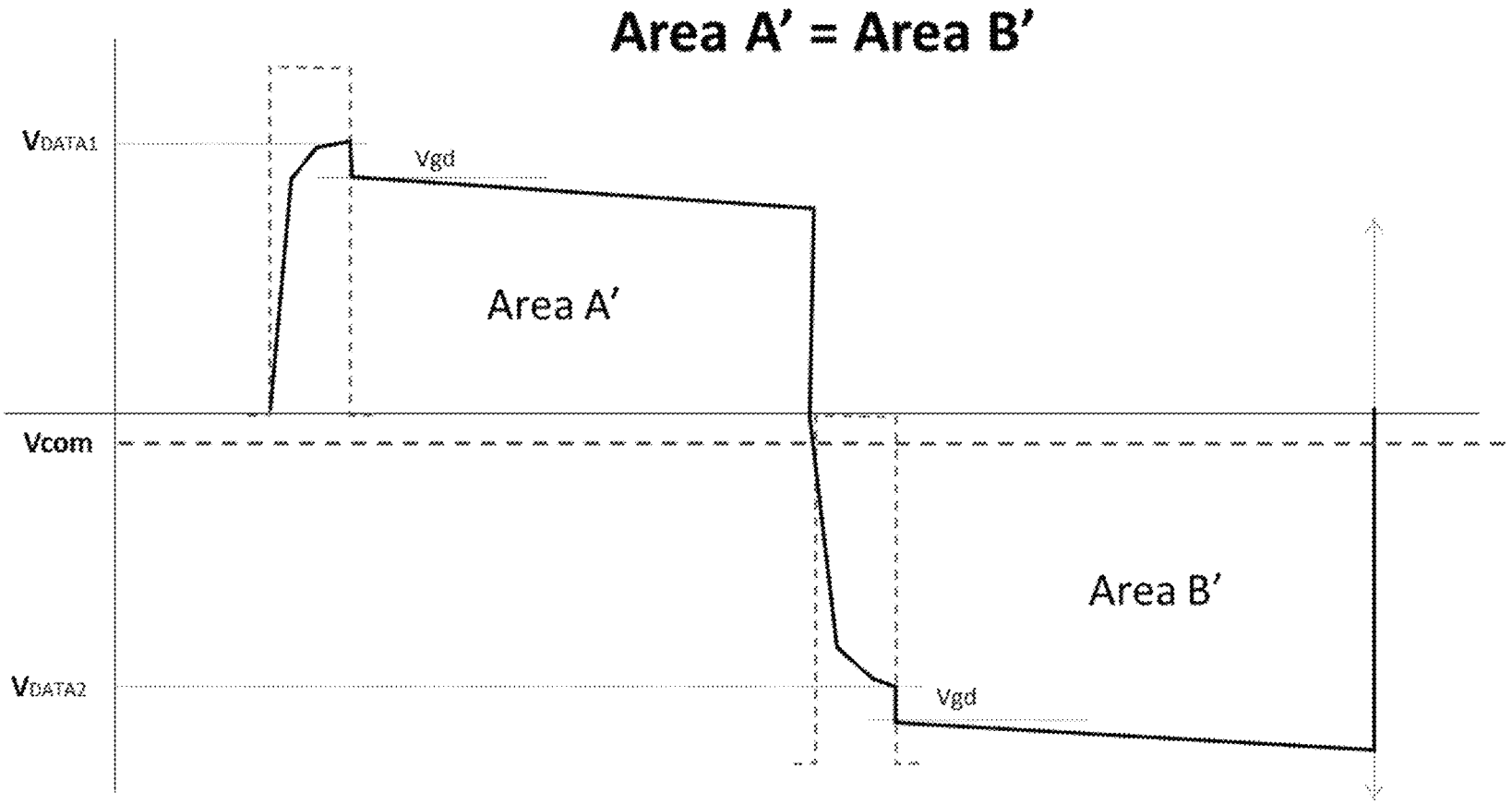
FIG. 8 shows a graph of voltage and discharge time for a variable Vcom level.

FIG. 8 shows a graph of voltage and discharge time for a variable Vcom level. To prevent or reduce flicker, a variable Vcom level can be used. A gap of area A and area B is compensated for by using a variable Vcom level.

Therefore, by tuning the Vcom voltage level, this will allow applying of symmetric average voltage to the LCD. Normally a level of Vcom is adjusted and fixed to minimize flicker level while at the factory and before panel is shipped out. Once set at the factory, the Vcom level is not changed again.

An adaptive Vcom level generator circuit (AVLG) supports (i) variable Vcom levels that are adaptively changed based on different vertical frequencies or (ii) variable Vcom levels that are changed based on external control signals. The circuit to generate variable Vcom levels may also be referred to as a variable Vcom level generator (VVLG).

Figure 9:
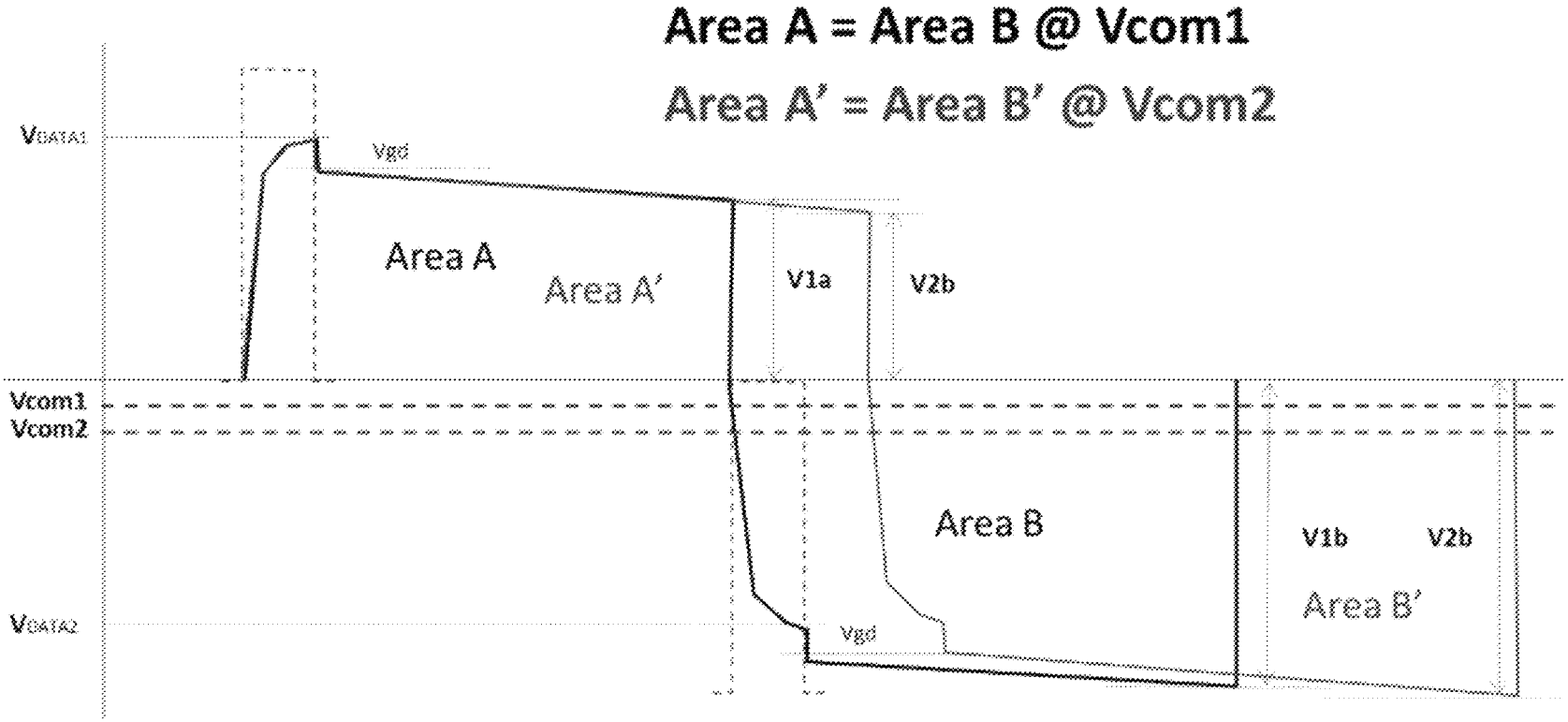
FIG. 9 shows a graph of voltage and discharge time for a variable Vcom at a Vcom1 level and Vcom2 level.

FIG. 9 shows a graph of voltage and discharge time for a variable Vcom at a Vcom1 level and Vcom2 level. When the display controller or GPU can generate different vertical frequencies, with the adaptive Vcom level generator circuit, the Vcom level can also be changed to make a more balanced area (e.g., area A=area B). As shown, an area A is equal to area B at a Vcom1 level. An area A' is equal to area B' at a Vcom2 level. Thus, using a variable Vcom level, flicker will be minimized by minimizing a gap or difference between of area A and area B.

Figure 10:
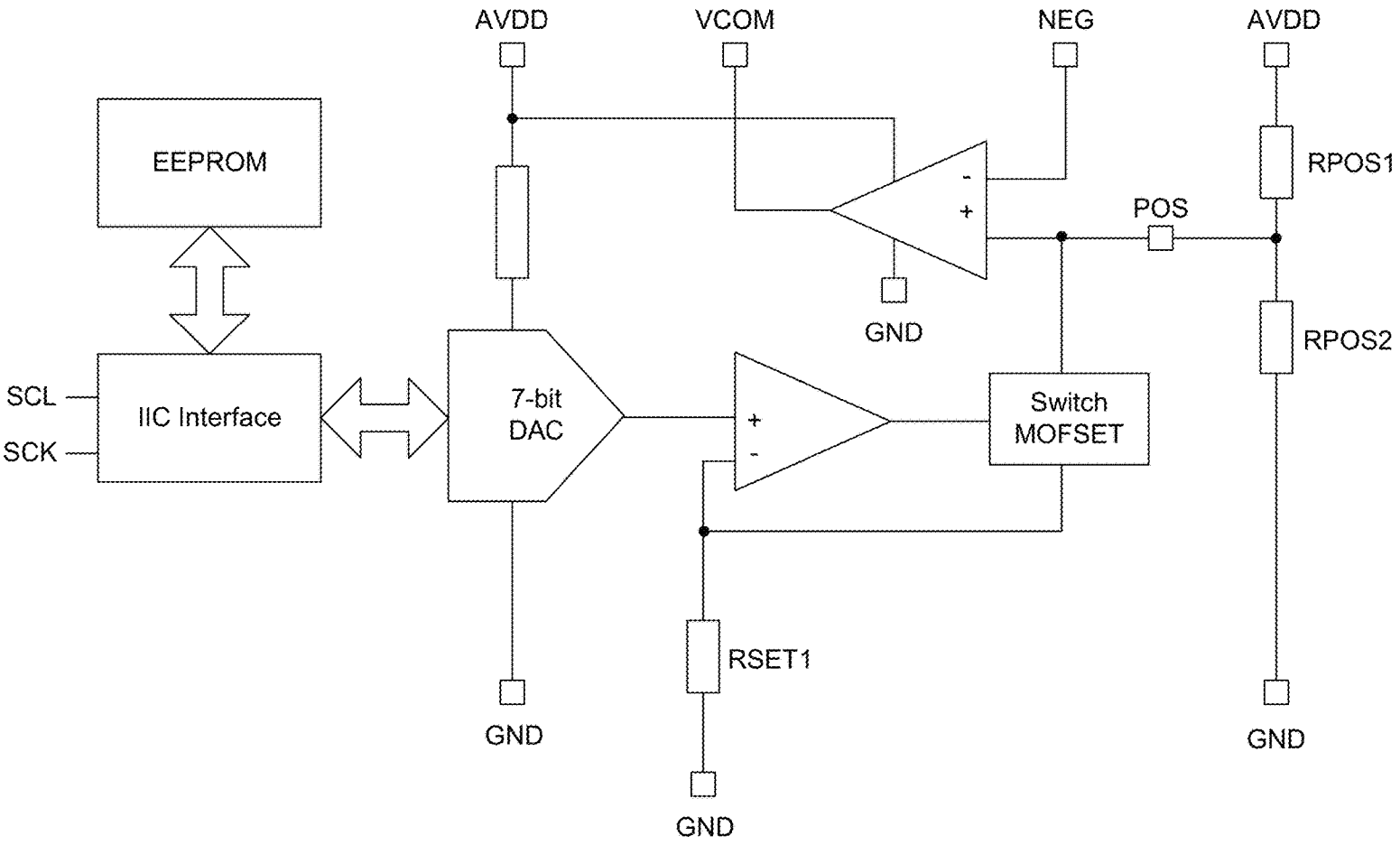
FIG. 10 shows a block diagram of a Vcom generator circuit.

FIG. 10 shows a block diagram of a Vcom generator circuit. This circuit includes a DVR block, I2C interface block, EEPROM or Flash storage, and power amplifier. A Vcom level is set through an I2C interface and is stored in the EEPROM. The Vcom level is not changed until a user writes a value of the Vcom level through I2C interface again.

It is not practical to write Vcom values while using this circuit with an LCD monitor. The typical user does not have access to specialized tools (e.g., hardware or software, or both). Also, it takes some time to write through I2C interface. It is impractical to change Vcom levels quickly in a Vcom generator of this configuration to avoid flicker because for variable refresh rate technology, the vertical frequency can be changed quickly (e.g., frequently and without advance notice) and the amount of rate change can be in a relatively wide rage.

The I2C bus interface (or Inter-Integrated Circuit) is a multi-master serial single-ended computer bus developed by Philips that is used to attach low-speed peripherals to a motherboard, embedded system, cellphone, or other electronic device. The I2C specification can be found at the NXP Semiconductor Web site and documented in Philips Semiconductors, "The I2C-Bus Specification, Version 2.1," January 2000 (document order no. 9398 383 40011). Documents on the I2C interface are incorporated by reference. The I2C bus interface is sometimes referred to as the IIC bus interface.

Figure 11:
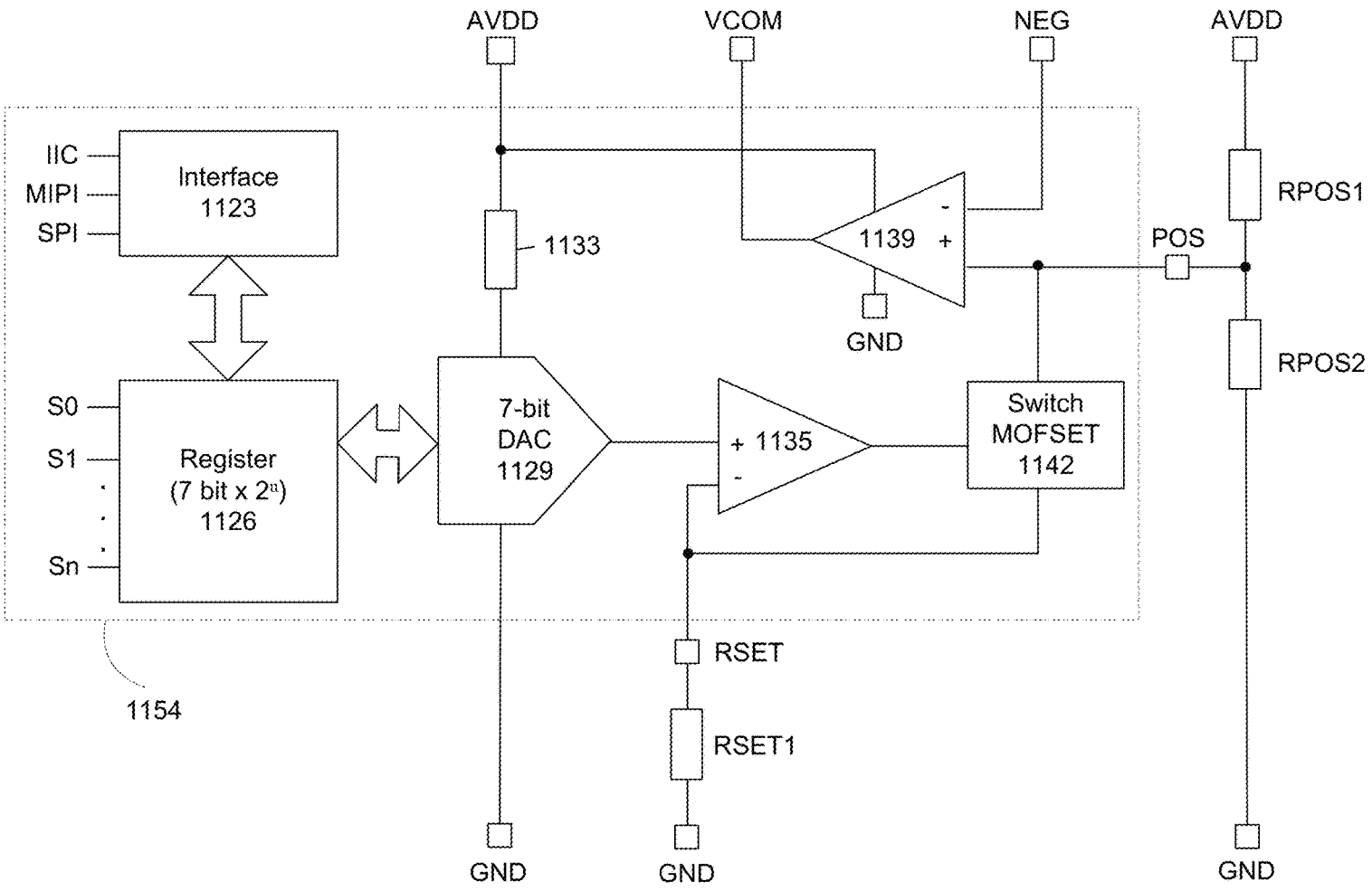
FIG. 11 shows a block diagram of a variable Vcom level generator circuit.

FIG. 11 shows a block diagram of a variable Vcom level generator circuit. The circuit includes a digitally variable resistor (DVR) circuit, driver amplifier, digital interface 1123, additional registers 1126, and control signals that are connected to the interface (e.g., I2C, IIC, MIPI, or SPI) and register (e.g., S0, S1, S2, . . . , Sn). The control signals to the digital interface can be referred to as digital interface control signals. The control signals to the register can be referred to as register control signals. Registers 1126 can be implemented using memory, static or dynamic memory (SRAM or DRAM), EEPROM, Flash, PLA, PLD, FPGA, latches, flip flops, register file, or other volatile or nonvolatile storage and related circuits.

The register is connected a digital-to-analog converter (DAC) 1129. Although a register is described, any other technique used to store binary values in a chip may be used including memory, static memory or SRAM, EEPROM, Flash, PLA, PLD, FPGA, latches, flip flops, registers, and others, and combinations of these. In a specific implementation, the DAC is 7 bits. However, in other implementations can use a DAC have less than 7 bits (e.g., 1, 2, 3, 4, 5, or 6 bits) or more than 7 bits (e.g., 8, 10, 12, 14, 16, 18, 20, 24, 32, or other number of bits). AVDD connects through an impedance 1133 (e.g., resistor or resistance) to provide power the DAC. The DAC is connected to a first operational amplifier or op amp 1135.

For a 7-bit or n-bit DAC, and the register (e.g., register file or memory) will have a similar number of bits—7 or n bits. There can be 2^n registers (e.g., for n=3, eight registers) in the register file (e.g., eight memory locations) to allow storing of up to 2^n different values (e.g., eight different values). This will allow up to 2^n different VCOM levels (e.g., eight different VCOM levels). The amount of memory of number of registers can vary depending on the number of VCOM levels desired.

AVDD (e.g., analog VDD supply) supplies power to the first op amp (not shown) and to a second op amp 1130. VCOM is connected to an output of the second op amp. A negative (−) input of the second op amp is connected to a NEG node, which is connected a pin or pad. A positive (+) input of the second op amp is connected to a bias voltage generated by a divider of resistors or resistances RPOS1 and RPOS2. In a specific implementation, the NEG node is connected to the VCOM output node. The connection between NEG and VCOM nodes may be made by external connection, which is external to an integrated circuit having these nodes as external pads.

In an implementation, the second op amp can be a unity gain buffer or a voltage follower, where the output voltage follows or tracks the input voltage provided at the positive and negative inputs. The negative input to the second op amp is the NEG node.

This bias voltage may also be referred to as a DVR output (POS). RPOS2 is also connected to ground. The POS node is connected to a pin or pad. The POS node is connected between RPOS1 and RPOS2 is connected to a first node (e.g., drain node) of a transistor 142 (e.g., a switch MOSFET). A second node (e.g., source node) of the transistor is connected to a negative (−) input of the first op amp and to a RSET node. The POS node is connected to a pin or pad. The RSET node is connected to a resistor or resistance RSET1. RSET1 is also connected to ground.

In an implementation, the transistor is an n-channel or NMOS transistor, but in other implementation, the transistor can be a p-channel or PMOS transistor. In still further implementations, the transistor can be a bipolar (or BJT) or JFET transistor. An output of the first op amp is connected to a third node (e.g., gate node) of the transistor.

In an implementation, the components within box 1154 reside on a single integrated circuit or chip. These components include interface 1123, register 1126, DAC 1129, impedance 1133, op amp 1135, op amp 1139, and transistor 1142. The components RSET, RPOS1, and RPOS2, which are resistors or resistances, are external to this integrated circuit. Externals pads of integrated circuit include AVDD, VCOM, NEG, POS, RSET, and GND. In an implementation, one or more of the resistors RPOS1, RPOS2, or RSET1, in any combination, are part of the single integrated circuit.

In another implementation, components within box 1154 can reside on multiple integrated circuits or chips. For example, op amp 1135 and op amp 1139 can be on separate integrated circuits. In a further example, interface 1123 and register 1126 are on a separate integrated circuit from the DAC and op amps.

Compared to the Vcom circuit in FIG. 10, the variable Vcom circuit includes the digital interface and register. By way of the register control signals (e.g., S0, S1, S2, . . . , Sn), a control circuit can select an particular voltage level for the Vcom voltage. The control circuit that generates the control signals to the register can be from a timing controller circuit such as a T-con circuit or board, or other source (e.g., external source such as signals from different integrated circuit or board).

The T-con circuit typically refers to a circuit or printed circuit board of a display (e.g., LCD panel). The T-con circuit provides control logic signals for driving the display. Sometimes the T-con circuit is referred to as a timing controller circuit, control circuit, controller board, or control board.

There can be any number of voltage levels, two or more (e.g., 2, 3, 4, 5, 6, 7, 8, 9, 16, 24, and more). The number of voltage levels (n+1) is related to the number of control lines by 2^n (which is 2 to the nth power), where n is an integer, 0 or greater. For example, for 8 voltage levels, these can be selected via three register control lines S0, S1, and S2. For 16 voltage levels, these can be selected via four register control lines S0 S1, S2, and S3.

Using the digital interface control signals (e.g., IIC, MIPI, or SPI), the circuitry allows a user to specify preset or selected values Vcom levels to be associated with a specific register. For example, the Vcom circuit may have eight register locations, selectable via three S control bits. Via the digital interface (e.g., IIC, MIPI, or SPI signals), a user can assign a Vcom1 level to register location 011 (decimal 3) and a Vcom level 4 to register location 100 (decimal 5). Then, when the control circuit sends 011 to the S controls bits, the digital analog converter (DAC) converts, and the Vcom level will be set to Vcom1.

In an implementation, the VCOM output levels are a function of a VCOM register value (which is the value output from register 1126 to the DAC), RPOS1 resistance value, RPOS2 resistance value, RSET resistance value, and the DAC reference voltage or AVDD. The VCOM outputs levels can be calculated by equations provided in table A below.

TABLE A

| Equation Number | Equation |
|---|---|
| I | $\text{Vcom} = \frac{\text{AVDD} \times \text{R}_{POS1}}{\text{R}_{POS1} + \text{R}_{POS2}} \times \left(1 - \frac{\text{R}_{POS1}}{20 \times \text{R}_{SET}} \times \frac{\text{DAC code}}{128}\right) \pm \text{V}_{OS}$ |
| II | $\text{Vcom_max} = \frac{\text{AVDD} \times \text{R}_{POS1}}{\text{R}_{POS1} + \text{R}_{POS2}}$ |
| III | $\text{Vcom_min} = \frac{\text{AVDD} \times \text{R}_{POS1}}{\text{R}_{POS1} + \text{R}_{POS2}} \times \left(1 - \frac{\text{R}_{POS1}}{20 \times \text{R}_{SET}} \times \frac{127}{128}\right)$ |
| IV | $\text{Vcom_step} = \frac{\text{Vcom_max} - \text{Vcom_min}}{127}$ |

Equation I gives a Vcom voltage level for given values for AVDD, RPOS1, RPOS2, RSET, a DAC code, and VOS. The DAC code is the digital value input the DAC. For 7-bit DAC, the value can be from 0 to 127. VOS is an offset voltage.

Equation II gives a Vcom_max voltage level, which is a maximum voltage level for Vcom. Equation III gives a Vcom_min voltage level, which is a minimum voltage level for Vcom. The voltage range output of the DAC will be from the Vcom_min voltage level to Vcom_max voltage level. Equation IV gives a Vcom_step voltage, which is a voltage difference or step size between each digital step at the input of the DAC. Sometimes the Vcom_step voltage is referred to as the resolution of the DAC.

In an implementation, the circuitry has an auto mode and a manual mode. In auto mode, the circuitry adjusts the VCOM output level based changes at the S0-Sn inputs (which are based on the vertical frequency of the video signal). In the manual mode, the user can select or set a particular VCOM output level. The user makes this selection through digital interface 1123 (e.g., IIC, MIDI, or SPI signals).

To provide an example, values for a specific implementation of the circuit are in table B. For this implementation, AVDD is 10 volts, RPOS1 is 100 kiloohms, RPOS2 is 100 kiloohms, and RSET is 20 kiloohms. Equation number V gives the VCOM level equation with these specific values. For a given DAC code, the equation can be used to calculate the corresponding VCOM level. For example, for a DAC code of 64, the VCOM level will be at about 4.375 volts (plus or minus the offset voltage).

TABLE B

| Equation Number | Equation |
|---|---|
| V | $\text{Vcom} = \frac{\text{AVDD} \times \text{R}_{POS1}}{\text{R}_{POS1} + \text{R}_{POS2}} \times \left(1 - \frac{\text{R}_{POS1}}{20 \times \text{R}_{SET}} \times \frac{\text{DAC code}}{128}\right) \pm \text{V}_{OS}$ <br> $= \frac{10\ \text{V} \times 100\text{kohms}}{100\text{kohms} + 100\text{kohms}} \times \left(1 - \frac{100\text{kohms}}{20 \times 20\text{kohms}} \times \frac{64}{128}\right) \pm V_{OS}$ <br> $= 4.375\ \text{V} \pm 30\ \text{mV}$ |
| VI | $\text{Vcom_max} = \frac{\text{AVDD} \times \text{R}_{POS1}}{\text{R}_{POS1} + \text{R}_{POS2}} = \frac{10\ \text{V} \times 100\text{kohms}}{100\text{kohms} + 100\text{kohms}} = 5.000\ \text{V}$ |

TABLE B-continued

| Equation Number | Equation |
|---|---|
| VII | $\text{Vcom_min} = \frac{\text{AVDD} \times \text{R}_{POS1}}{\text{R}_{POS1} + \text{R}_{POS2}} \times \left(1 - \frac{\text{R}_{POS1}}{20 \times \text{R}_{SET}} \times \frac{127}{128}\right)$ <br> $= \frac{10\ \text{V} \times 100\text{kohms}}{100\text{kohms} + 100\text{kohms}} \times \left(1 - \frac{100\text{kohms}}{20 \times 20\text{kohms}} \times \frac{127}{128}\right)$ <br> $= 3.7598\ \text{V}$ |
| VIII | $\text{Vcom_step} = \frac{\text{Vcom_max} - \text{Vcom_min}}{127} = 9.77\ \text{mV@10 mV}$ |

Equation VI gives the maximum VCOM level or 5 volts. Equation VII gives the minimum VCOM level or 3.7598 volts. Equation VIII gives the VCOM level step size of 9.77 millivolts (or about 10 millivolts). Thus, the VCOM output level will range from 3.7598 volts to 5 volts, with a voltage difference of about 10 millivolts between steps.

In an implementation, the variable Vcom level generator circuit does not include a frequency detection circuit. Many existing T-con circuits can detect a vertical frequency of the display. The variable Vcom level generator circuit uses the frequency detected by the T-con circuit to select the Vcom level.

A frequency detection circuit does not need to be included in the same integrated circuit with this variable Vcom level generator circuit. This reduces the amount of circuitry, compared to an adaptive Vcom level generator circuit that includes a frequency detection circuit (e.g., oscillator circuit). The variable Vcom level generator circuit will have reduced cost since less there will be less complexity, less circuitry, and less integrated circuit area required.

In a further implementation, the T-con circuit can detect frequency ranges and generate the register control signals directly for the variable Vcom level generator circuit. The register control signals generated by the T-con would appropriately select the Vcom voltage level for a particular vertical frequency.

Figure 12:
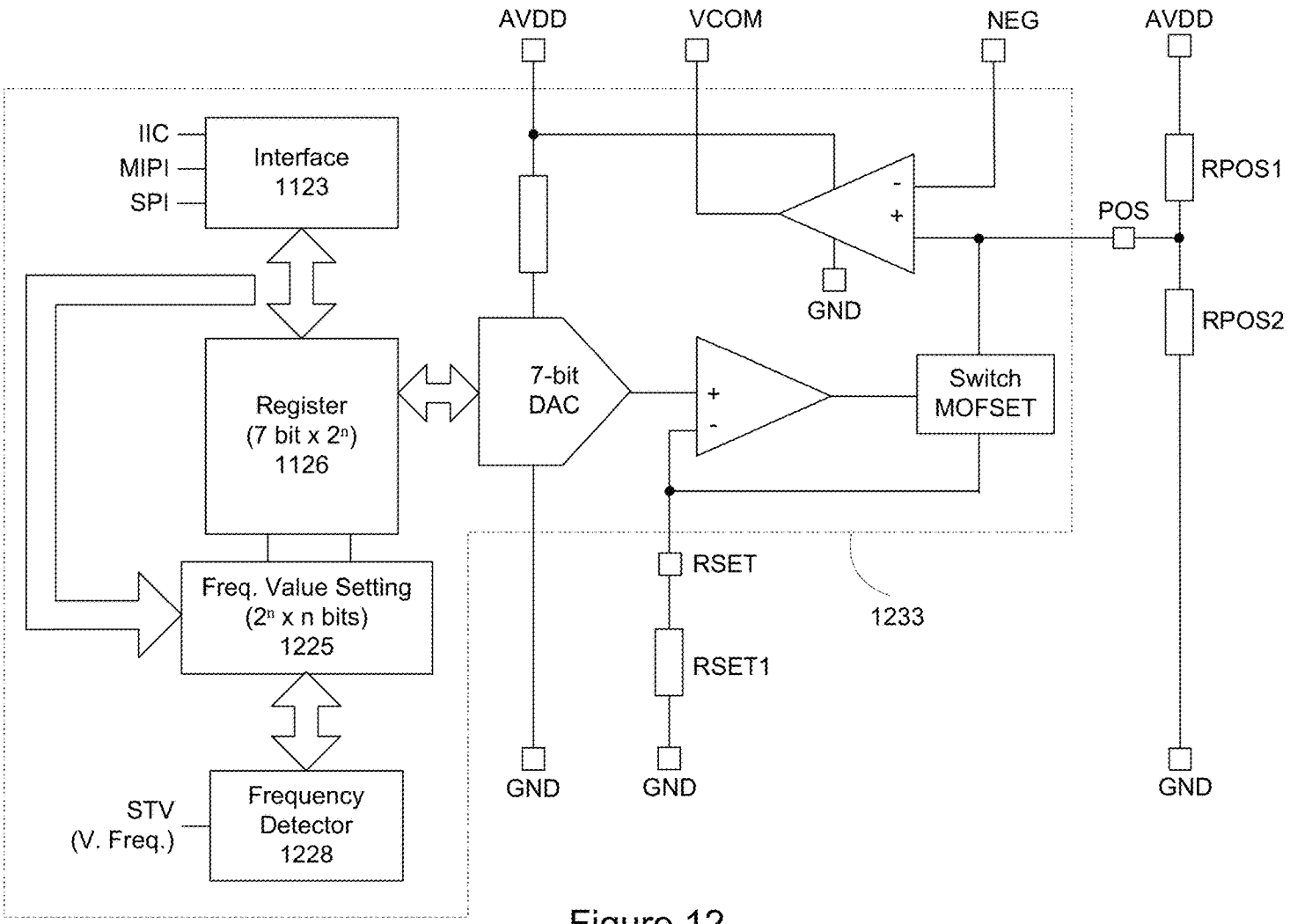
FIG. 12 shows a block diagram of variable Vcom level generator circuit with frequency detection circuit.

FIG. 12 shows a block diagram of variable Vcom level generator circuit with frequency detection circuit. The circuit is similar to the circuitry in FIG. 11. This circuitry further includes a frequency value setting circuit 1225 and a frequency detector circuit 1228. In an implementation, the circuitry within a box 1233 reside on the same integrated circuit. In other implementations, frequency value setting circuit 1225 or a frequency detector circuit 1228, or both, may be on different integrated circuits from the other circuitry.

Frequency detector circuit 1228 and digital interface 1123 are connected to frequency value setting circuit 1225. The frequency value setting circuit outputs the register control signals (e.g., S0, S1, S2, . . . , Sn) that connect to register 1126. Via the register control signals, the frequency value setting circuit selects a particular Vcom level for a particular vertical frequency or vertical frequency range. In an implementation, the frequency value setting circuit stores a digital frequency table with values for a various frequencies. This table of values stored using any other technique or circuit used to store binary values in a chip may be used including memory, static memory or SRAM, EEPROM, Flash, PLA, PLD, FPGA, latches, flip flops, registers, and others, and combinations of these.

An STV video signal having a specific vertical frequency is input to the frequency detector. The frequency detector determines the vertical frequency and outputs this to the frequency value setting circuit. Given the vertical frequency (which may be a range of vertical frequencies), the frequency value setting circuit controls selection of an appropriate Vcom level by generating appropriate register control signals (e.g., S0, S1, S2, . . . , Sn).

For example, the detected vertical frequency can be in a wide range from 10 Hertz to about 144 Hertz. When the frequency is in a range from 10 to 20 Hertz, the frequency value setting circuit will generate register control signals to select a Vcom1 level. When the frequency is in a range from 55 Hertz to 78 Hertz, the frequency value setting circuit will generate register control signals to select a Vcom2 level.

In an implementation, there are eight detected vertical frequencies: 9 Hertz, 30 Hertz, 50 Hertz, 60 Hertz, 120 Hertz, 144 Hertz, 240 Hertz, and 255 Hertz. For each frequency, there is a corresponding VCOM voltage level that is selected by a value stored in the VCOM register. The VCOM register has addresses VCOM0 to VCOM7, where VCOM0 is the lowest address and VCOM7 is the highest address. The contents of the VCOM register can be organized so the contents in the lowest register will be for the lowest frequency, each next register in succession will for the next higher frequency, and the contents in the highest register will be for the highest frequency.

In other implementations, the VCOM register can be organized according to other techniques, sortings, or in an arbitrary assignments. For example, the VCOM voltage level for highest frequency will be stored in the lowest register, each next lower register will for the next lower frequency, and the contents in the highest register will be for the lowest frequency.

For the above implementation, there is a 7-bit DAC and seven register locations that allow for up to seven different VCOM voltage levels for up to seven different frequencies. However, in other implementations, for an n-bit DAC, there can be up to 2^n register (which is 2 to the nth power) locations to allow for 2^n specific voltages for 2^n different frequencies. The above examples have described a 7-bit DAC. As previously stated, the DAC can have more or fewer bits of resolution. The value of n can be an integer 1 or greater.

With the digital interface, the digital interface control signals (e.g., IIC, MIPI, or SPI signals) are input to the frequency value setting circuit. Via the digital interface control signals, the user can (i) assign particular Vcom levels to register locations, and also (ii) assign particular Vcom levels to a vertical frequency or a vertical frequency range.

Since this variable Vcom level generator circuit has a frequency detector circuit, an external vertical frequency detector (such as via a T-con circuit) is not needed.

Frequency detector circuit 1228 can use any technique to determine the vertical frequency. The STV video signal or the vertical frequency sync signal is a timing signal with pulses to indicate the start of a new field of a view. To display video (e.g., television signals), the fields of the video are at a particular vertical frequency. For interlaced video, two fields make up one frame. For progressive video, there is one field per frame. The STV signal has a series pulse that indicates the start of a new field. The time between pulses gives a period of the vertical frequency. And the inverse of the period is the vertical frequency. The vertical frequency is also known as the refresh rate or scanning rate. Using the STV signal, one can determine the vertical frequency.

Figure 13:
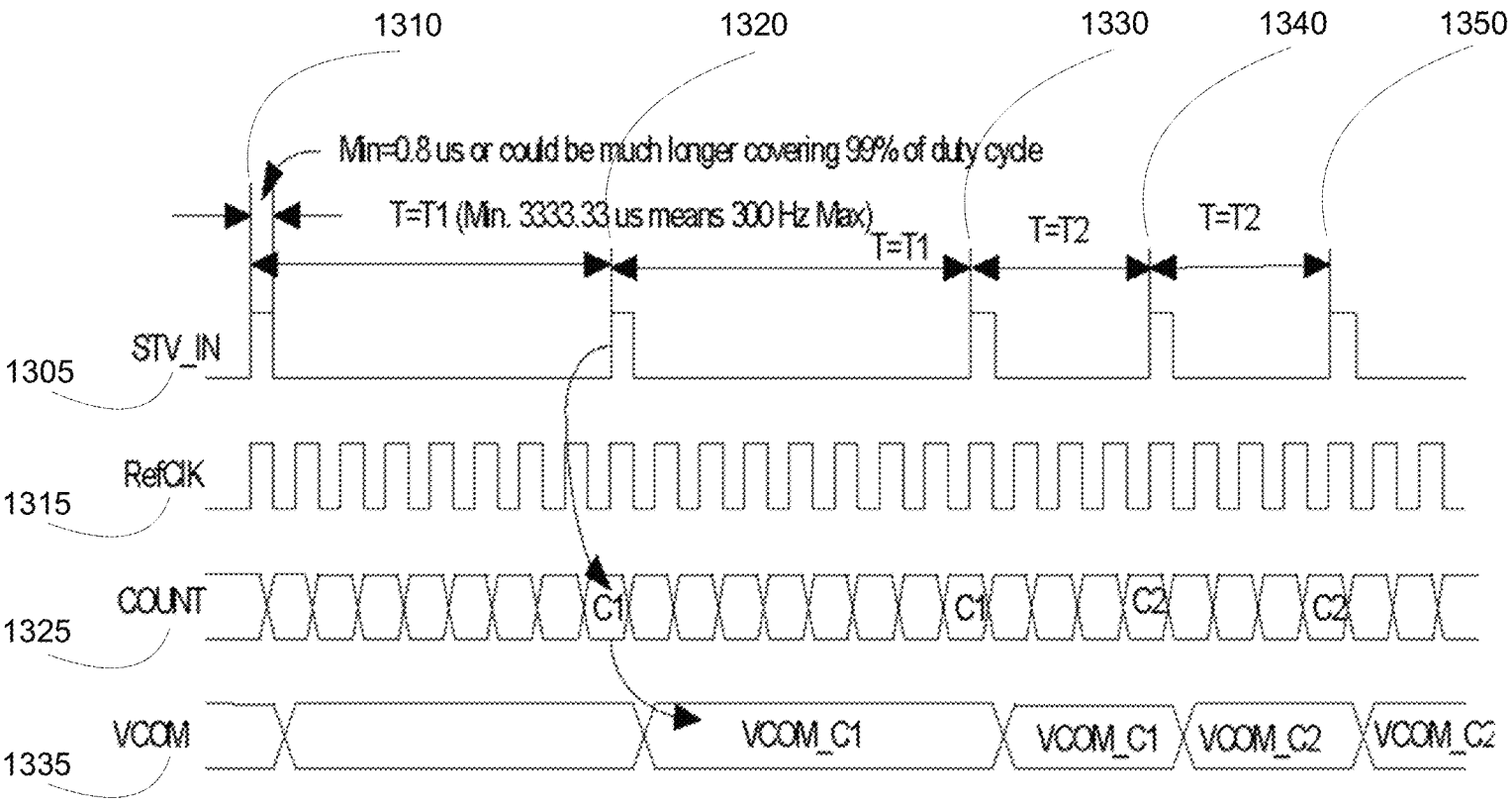
FIG. 13 shows a timing diagram for technique of determining a display's vertical frequency.

FIG. 13 shows a timing diagram for technique of determining a display's vertical frequency. In this technique, an input is STV or STV_IN 1305, which is the vertical frequency sync system. There is a clock RefCLK 1315 for the circuitry. RefCLK can also be used to clock register 1126 and the DAC. There is a counter COUNT 1325, which is clocked using RefCLK. Counter COUNT can be part of frequency detector circuitry 1228. There is a VCOM register output 1335, which gives the address of the register, whose contents are passed to the DAC to generate an appropriate VCOM voltage level output.

RefCLK can be generated by an internal clock circuit or external clock circuit. For example, the VCOM circuit can include an oscillator or clock generator, which can be implemented using a ring oscillator circuit, such as an inverter chain with an odd number of inverters (e.g., 1, 3, 5, 7, 9, 11, 12, or other). There can be resistance-capacitance-inductance (RCL) loads resistance-capacitance loads between one or more stages or each and every stage. The output of the ring oscillator is a pulse train, square wave signal, or other clock-type signal. A desired oscillator frequency can be obtained by adjusting the number of stages and loads. In other implementations, the clock generator or oscillator can be an external circuit, not residing on the same integrated circuit as the other components (such as frequency detector 1225). For example, a quartz crystal oscillator or clock generator integrated circuit can be used as external oscillator, which would have a clock output that would connect to the frequency detector 1225 through an external pad.

After a first pulse at STV_IN 1310, the counter begins counting to determine a number of counts between first STV_IN pulse 1310 and a second STV_IN pulse 1320. Based on the number of counts between pulse 1310 and pulse 1320, VCOM register output 1335 is set to an appropriate value, indicated as VCOM_C1.

At the second pulse of STV_IN 1320, the counter is zeroed and the counter begins counting again until a third STV_IN pulse 1330. A period between pulse 1310 and 1320 is the same as a period between pulse 1320 and 1330. This means the vertical frequency is the same and has not changed. VCOM register output 1335 will remain at VCOM_C1.

At the third pulse of STV_IN 1330, the counter begins counting again until a fourth STV_IN pulse 1340. A period between pulse 1330 and 1340 is the less than the period between pulse 1320 and 1330. The period is less, which means the vertical frequency has increased. VCOM register output 1335 is changed to a different value, VCOM_C2, which causes the DAC to output an appropriate VCOM voltage level for the new vertical frequency.

At the fourth pulse of STV_IN 1340, the counter begins counting again until a fifth STV_IN pulse 1350. A period between pulse 1340 and 1350 is the same as a period between pulse 1330 and 1340. This means the vertical frequency is the same and has not changed. VCOM register output 1335 will remain at VCOM_C2. With each succeeding STV_IN pulse, operation continues as described above.

A minimum pulse width of STV_IN can be 0.8 microseconds or could be much longer, covering 99 percent of the duty cycle. The counter begins count at a rising edge of the STV_IN pulse. The period between pulse 1310 and 1320 can be a value T1, which is 3333.33 microseconds or 300 Hertz.

In an implementation, the circuitry has a slow mode or feature. The slow feature is turned off by default, but can be enabled to limit a rate of change of the VCOM voltage level output. For example when the SLOW feature is enabled, a change VCOM register output 1335 may be limited to X registers or less, where X is a integer between 1 to 7 (for a 7-bit DAC). When slow feature is off, X is 7, so the can be in VCOM register output 1335 can change the full range at a time—from VCOM0 register to VCOM7 register. In slow mode, this can be limited to.

For example, X can be set to 3, then the maximum change will be from the VCOM0 register to the VCOM3 register at a time between STV_IN pulses. From VCOM3, the next maximum change can be to VCOM6. And operation can continue in this manner.

This description of the invention has been presented for the purposes of illustration and description. It is not intended to be exhaustive or to limit the invention to the precise form described, and many modifications and variations are possible in light of the teaching above. The embodiments were chosen and described in order to best explain the principles of the invention and its practical applications. This description will enable others skilled in the art to best utilize and practice the invention in various embodiments and with various modifications as are suited to a particular use. The scope of the invention is defined by the following claims.

The invention claimed is:

1. A method comprising:

receiving a vertical frequency signal;

providing a reference clock at a reference frequency;

detecting a first pulse in the vertical frequency signal;

detecting a second pulse in the vertical frequency signal, wherein the second pulse is after the first pulse;

upon detecting the first pulse, counting using a counter circuit, clocked by the reference clock, a number of reference clock cycles between the first pulse and the second pulse to obtain a first count value;

based on the first count value, selecting a first register in the register block to output to a digital-to-analog converter (DAC) circuit, wherein the first register stores a first binary value;

based on the first binary value, generating a first DAC voltage output; and based on the first DAC voltage output, generating a first VCOM voltage output level on a VCOM voltage output line.

2. The method of claim 1 comprising:

detecting a third pulse in the vertical frequency signal, wherein the third pulse is after the second pulse;

after obtaining a first count value, resetting the counter circuit to zero;

upon detecting the second pulse, counting using the counter circuit a number of reference clock cycles between the second pulse and the third pulse to obtain a second count value;

based on the second count value, selecting a second register in the register block to output to the DAC circuit, wherein the second register stores a second binary value, and the second binary value is different from the first binary value;

based on the second binary value, generating a second DAC voltage output, wherein the second DAC voltage output is different from the first DAC voltage output;

based on the second DAC voltage output, at the VCOM voltage output line, changing from the first VCOM voltage output level to a second VCOM voltage output level, wherein the second VCOM voltage output level is different from the first VCOM voltage output level.

3. The method of claim 2 wherein when the first count value is greater than the second count value, the second VCOM voltage output level is greater than the first VCOM voltage output level.

4. The method of claim 2 wherein when the first count value is greater than the second count value, the second VCOM voltage output level is less than the first VCOM voltage output level.

5. The method of claim 1 wherein the vertical frequency signal is received from a T-con circuit of a display panel.

6. The method of claim 1 comprising:

via digital interface control signals, programming via a digital interface circuit the first binary value that is stored in the first register of the register block.

7. The method of claim 1 wherein the based on the first DAC voltage output, generating a first VCOM voltage output level on a VCOM voltage output line comprises:

coupling an output of the digital-to-analog converter (DAC) circuit through at least one operational amplifier circuit to the VCOM voltage output line.

8. The method of claim 1 wherein the based on the first DAC voltage output, generating a first VCOM voltage output level on a VCOM voltage output line comprises:

coupling an output of the digital-to-analog converter (DAC) circuit through at least two operational amplifier circuits to the VCOM voltage output line.

9. The method of claim 1 comprising:

providing a first impedance value coupled between a first supply line and a first node;

providing a second impedance value coupled to a second supply line and the first node; and coupling the first node to an input of an operational amplifier circuit, wherein an output of the operational amplifier circuit is coupled to the VCOM voltage output line.

10. The method of claim 8 wherein the at least two operational amplifier circuits comprises a first operational amplifier circuit and a second operational amplifier circuit, and the method comprises:

coupling a transistor between the first operational amplifier circuit and the second operational amplifier circuit.

11. The method of claim 1 wherein the counter circuit and DAC circuit reside on a single integrated circuit.

12. A device comprising:

a frequency detector circuit, coupled to a vertical frequency signal line of a display, wherein the frequency detector circuit comprises a counter circuit;

a register block, coupled to a frequency detector circuit, wherein the register block receives a value based on the counter circuit;

a digital-to-analog converter circuit, coupled to the register block;

a first operational amplifier, comprising a first input coupled to the digital-to-analog converter circuit;

a transistor coupled to an output and a second input of the first operational amplifier; and a second operational amplifier, comprising a first input coupled to the transistor and an output coupled to a VCOM voltage output.

13. The device of claim 12 comprising:

a digital interface control circuit, coupled to the register block.

14. The device of claim 12 comprising:

a first impedance coupled between a supply line and a first node; and a second impedance coupled between the first node and a ground line, wherein the first node is coupled to the first input of the second operational amplifier.

15. The device of claim 12 comprising:

a supply line, coupled to the second operational amplifier; and a first impedance coupled between the supply line and the digital-to-analog converter circuit.

16. The device of claim 12 wherein the digital-to-analog converter circuit is a 7-bit digital-to-analog converter circuit and the register block is 7 bits wide.

17. The device of claim 12 wherein the register block comprises 8 registers, and the VCOM voltage output can provide up to 8 different VCOM voltage levels.

18. The device of claim 12 wherein the frequency detector circuit, counter circuit, digital-to-analog converter circuit, and register block reside on a single integrated circuit.

19. A method comprising:

receiving a vertical frequency signal from a display panel;

providing a reference clock at a reference frequency;

detecting a first pulse in the vertical frequency signal;

detecting a second pulse in the vertical frequency signal, wherein the second pulse is after the first pulse;

upon detecting the first pulse, counting using a counter circuit, clocked by the reference clock, a number of reference clock cycles between the first pulse and the second pulse to obtain a first count value;

based on the first count value, selecting a first register in the register block to output to a digital-to-analog converter (DAC) circuit, wherein the first register stores a first binary value;

based on the first binary value, generating a first DAC voltage output;

based on the first DAC voltage output, generating a first VCOM voltage output level on a VCOM voltage output line;

detecting a third pulse in the vertical frequency signal, wherein the third pulse is after the second pulse;

after obtaining a first count value, resetting the counter circuit;

upon detecting the second pulse, counting using the counter circuit a number of reference clock cycles between the second pulse and the third pulse to obtain a second count value, wherein the second count value is greater than the first count value;

based on the second count value, selecting a second register in the register block to output to the DAC circuit, wherein the second register stores a second binary value, and the second binary value is different from the first binary value;

based on the second binary value, generating a second DAC voltage output, wherein the second DAC voltage output is different from the first DAC voltage output; and based on the second DAC voltage output, at the VCOM voltage output line, changing from the first VCOM voltage output level to a second VCOM voltage output level, wherein the second VCOM voltage output level is different from the first VCOM voltage output level.

20. The method of claim 19 comprising:

coupling an output of the DAC circuit to a first operational amplifier circuit;

coupling an output of the first operational amplifier circuit to a transistor; and coupling the transistor to an input of a second operational amplifier circuit, wherein an output of the second operational amplifier circuit comprises the VCOM voltage output line.

* * * * *